US009004874B2

(12) United States Patent
Jamison

(10) Patent No.: US 9,004,874 B2
(45) Date of Patent: Apr. 14, 2015

(54) INTERLAMINAR STRESS REDUCING CONFIGURATION FOR COMPOSITE TURBINE COMPONENTS

(75) Inventor: Joshua Brian Jamison, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 555 days.

(21) Appl. No.: 13/402,642

(22) Filed: Feb. 22, 2012

(65) Prior Publication Data

US 2013/0216389 A1 Aug. 22, 2013

(51) Int. Cl.
*F01D 5/30* (2006.01)

(52) U.S. Cl.
CPC ..... *F01D 5/3084* (2013.01); *F01D 5/3007* (2013.01); *F05D 2250/712* (2013.01); *F05D 2300/6033* (2013.01)

(58) Field of Classification Search
USPC ..... 416/239, 248, 219 R, 219 A, 220 R, 416/220 A
See application file for complete search history.

(56) References Cited

U.S. PATENT DOCUMENTS

| | | | | |
|---|---|---|---|---|
| 5,435,694 | A * | 7/1995 | Kray et al. | 416/219 R |
| 2006/0140771 | A1* | 6/2006 | Carper et al. | 416/241 R |
| 2012/0134839 | A1* | 5/2012 | Parkin et al. | 416/230 |

FOREIGN PATENT DOCUMENTS

| | | |
|---|---|---|
| EP | 2372096 A2 | 10/2011 |
| FR | 2952964 A1 | 5/2011 |

OTHER PUBLICATIONS

Search Report and Written Opinion from corresponding EP Application No. 13155966, dated May 21, 2013.

* cited by examiner

*Primary Examiner* — Richard Edgar
(74) *Attorney, Agent, or Firm* — General Electric Company; William Scott Andes

(57) ABSTRACT

A turbomachinery blade includes: an airfoil; and a shank extending from a root of the airfoil, the shank being constructed from a composite material including reinforcing fibers embedded in a matrix The shank includes a pair of spaced-apart side faces that cooperatively define: a dovetail disposed at a radially inboard end of the shank, comprising spaced-apart, diverging faces; a first neck portion having a concave curvature disposed radially outboard of the dovetail, and defining a primary minimum neck at which a thickness of the shank is at a local minimum; and a second neck portion disposed radially outboard of the first minimum neck, the second neck portion having a concave curvature and defining a secondary minimum neck at which the thickness of the shank is at a local minimum.

9 Claims, 2 Drawing Sheets

INTERLAMINAR STRESS REDUCING CONFIGURATION FOR COMPOSITE TURBINE COMPONENTS

BACKGROUND OF THE INVENTION

This invention relates generally to composite components and more particularly to the configuration of mounting features of composite components such as turbomachinery airfoils.

It is desirable to manufacture gas turbine components such as turbomachinery blades from composite materials that provide favorable strength-to-weight ratios. Known types of composite materials include polymer matrix composites ("PMC"), typically suitable for fan blades, and ceramic matrix composites ("CMC"), typically suitable for turbine blades.

All of these composite materials are comprised of a laminate of a matrix material and reinforcing fibers and are orthotropic to at least some degree, i.e. the material's tensile strength in the direction parallel to the length of the fibers (the "fiber direction") is stronger than the tensile strength in the perpendicular direction (the "matrix" or "interlaminar" direction). The physical properties such as modulus and Poisson's ratio also differ between the fiber and matrix. The primary fiber direction in turbomachinery blades is typically aligned with the radial or spanwise direction in order to provide the greatest strength capability to carry the centripetal load imparted by the spinning rotor. As such, the weaker matrix, secondary or tertiary (i.e. non-primary) fiber direction is then orthogonal to the radial direction.

As composites have different coefficients of thermal expansion ("CTE") than metal alloys use for the rotor disk, all of the blade dovetails use a configuration that allows for free thermal expansion between the two parts. However, this type of dovetail configuration leads to a peak interlaminar tensile stress imparted in the shank of the composite blade, which must be carried in the weaker matrix material, just above the pressure faces of the dovetail, commonly referred to as the "minimum neck", which can be the limiting stress location in the blade design.

The matrix, or non-primary fiber direction strength, herein referred to as interlaminar strength, is typically weaker (i.e. 1/10 or less) than the fiber direction strength of a composite material system and can be the limiting design feature on composite blades, in particular, CMC turbine blades.

Accordingly, there is a need for a blade mounting structure which reduces interlaminar stresses in the mounting attachment region for a composite blade.

BRIEF DESCRIPTION OF THE INVENTION

This need is addressed by the present invention, which provides a turbomachinery blade structure that includes first and second minimum necks configured to produce reduced interlaminar tensile stresses during operation.

According to an aspect of the invention a turbomachinery blade includes: an airfoil; and a shank extending from a root of the airfoil, the shank being constructed from a composite material including reinforcing fibers embedded in a matrix, wherein the shank includes a pair of spaced-apart side faces. The side faces cooperatively define: a dovetail disposed at a radially inboard end of the shank, comprising spaced-apart, diverging faces; a first neck portion having a concave curvature disposed radially outboard of the dovetail, and defining a primary minimum neck at which a thickness of the shank is at a local minimum; and a second neck portion disposed radially outboard of the first minimum neck, the second neck portion having a concave curvature and defining a secondary minimum neck at which the thickness of the shank is at a local minimum.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
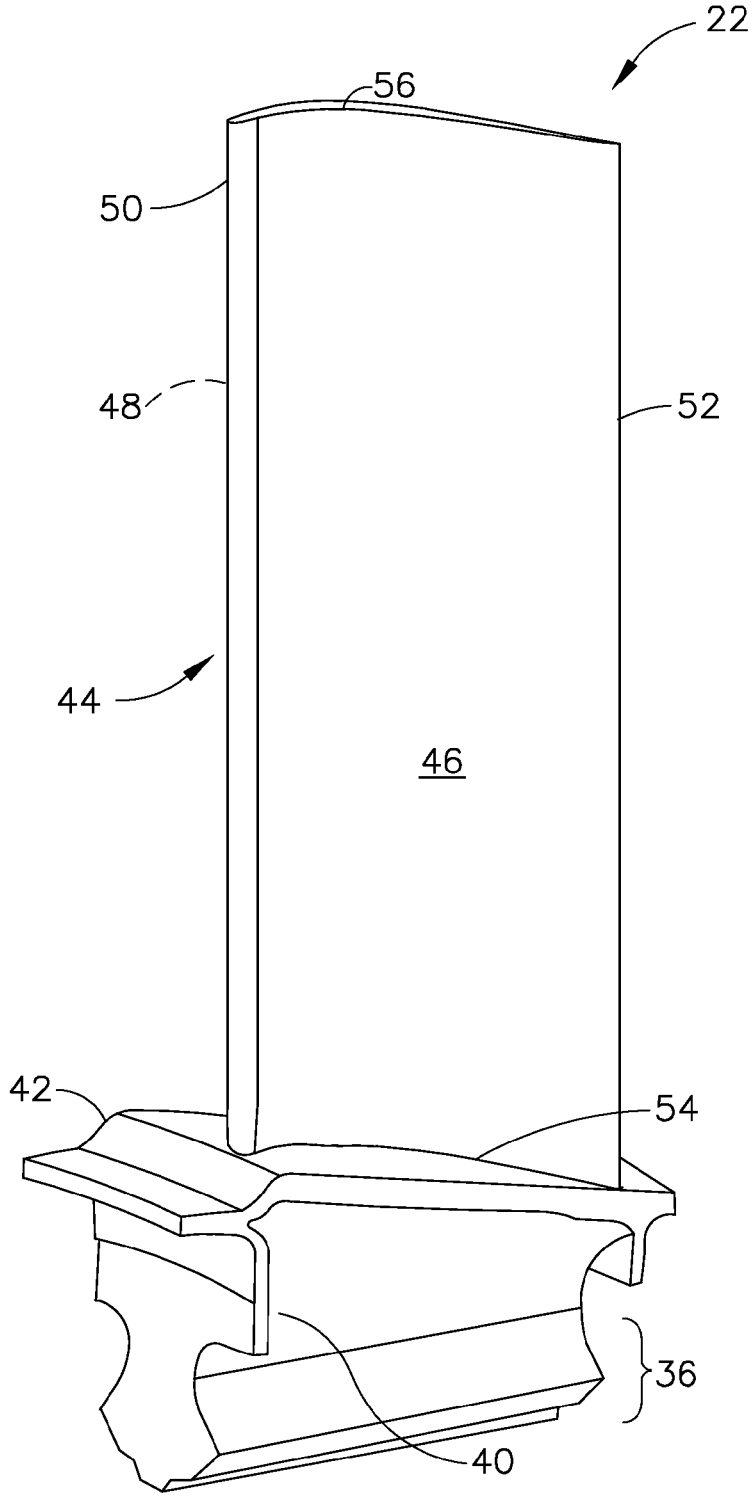
FIG. 1 is a perspective view of a turbine blade of a gas turbine engine.

Referring to the drawings wherein identical reference numerals denote the same elements throughout the various views, FIG. 1 illustrates an exemplary low-pressure turbine (or "LPT") blade 22. While illustrated and explained in the context of a LPT blade, it will be understood that the principles of the present invention are equally applicable to other types of turbomachinery airfoils, such as fan and compressor blades, high-pressure turbine ("HPT") blades, or stationary airfoils.

The turbine blade 22 is constructed from a composite material such as a CMC or PMC material, described in more detail below. The turbine blade 22 includes a dovetail 36 configured to engage a dovetail slot 38 (see FIG. 3) of a gas turbine engine rotor disk 24 of a known type, for radially retaining the turbine blade 22 to the rotor disk 24 as it rotates during operation. The dovetail 36 is an integral part of a blade shank 40. The shape of the shank 40 transitions from the dovetail 36 to the curved airfoil shape to allow for a smooth transition for composite layup. A platform 42 projects laterally outwardly from and surrounds the shank 40. The platform 42 may be integral to the turbine blade 22 or may be a separate component. An airfoil 44 extends radially outwardly from the shank 40. The airfoil 44 has a concave pressure side 46 and a convex suction side 48 joined together at a leading edge 50 and at a trailing edge 52. The airfoil 44 has a root 54 and a tip 56, which may incorporate a tip shroud. The airfoil 44 may take any configuration suitable for extracting energy from the hot gas stream and causing rotation of the rotor disk.

Figure 2:
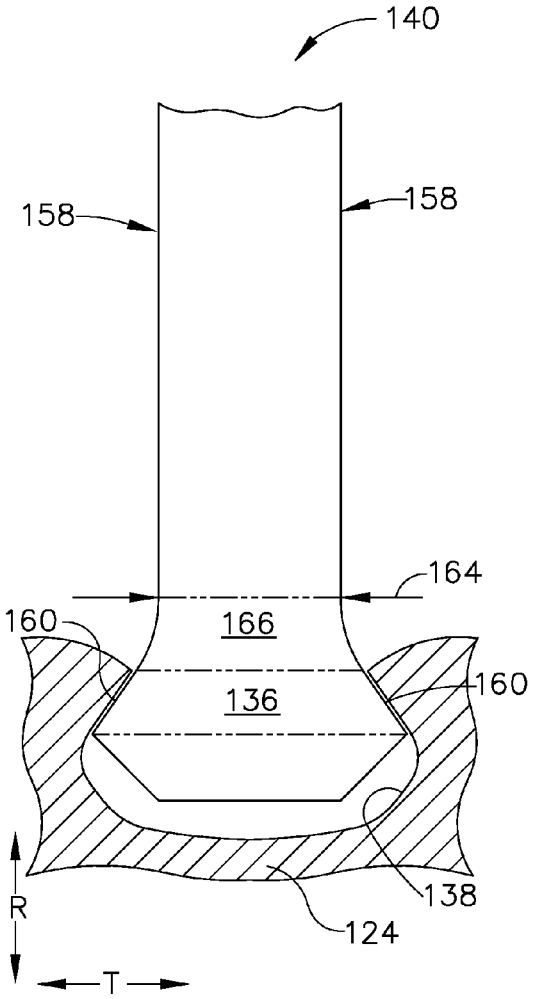
FIG. 2 (PRIOR ART)
FIG. 2 is a schematic, transverse sectional view of a shank portion of a prior art turbine blade.

For comparison purposes, FIG. 2 shows a schematic view of a shank 140 of a prior art turbine blade. The shank 140 includes spaced-apart generally parallel left and right side faces 158. At the radially inner end (or inboard end), The side faces 158 define a dovetail 136 having a pair of spaced-apart, divergent pressure faces 160. A concave-curved transition section 166 is disposed just outboard of the dovetail 136. The portion of the shank 140 where the transition section 166 meets the remainder of the side faces 158 constitutes a "minimum neck" 164. The thickness of the shank 140 in the tangential direction "T" is at a minimum at the location of the minimum neck 164. In operation, the primary load on the rotating turbine blade is in the radial (or spanwise) direction "R". As a result of blade radial force, the turbine blade is also subject to tensile stresses in the tangential direction T, caused by interaction of the pressure faces 160 with the dovetail slot 138 of a turbine rotor disk 124. The tangential stresses are of a much lower magnitude than the spanwise stresses. for example, the maximum radial, fiber, stresses may be about 10 times greater than the maximum tangential stresses. In a prior art turbine blade constructed from a isotropic, or near isotropic (i.e. directionally solidified) metal alloy, this does not present a problem as strengths in any direction are equivalent.

However, as noted above, composite materials are typically orthotropic to at least some degree. For example, the yield strength or the ultimate tensile strength of a composite material could exhibit a 10:1 or 15:1 ratio between the radial (fiber) and tangential (matrix or interlaminar) directions.

Figure 3:
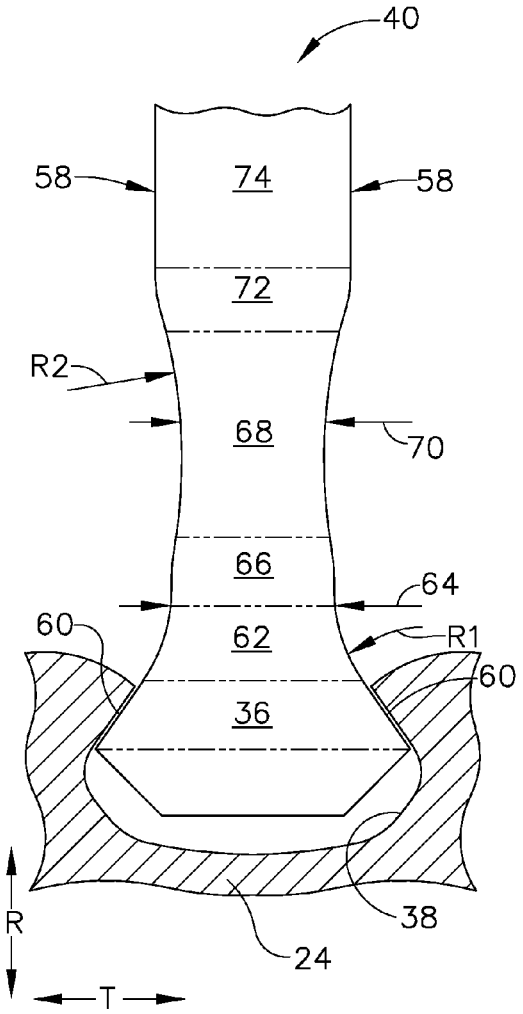
FIG. 3 is a schematic, transverse sectional view of a shank portion of a turbine blade constructed according to an aspect of the present invention.

Accordingly, the shank 40 of the turbine blade 22 seen in FIGS. 1 and 3 is configured to reduce the interlaminar stresses in the composite material that forms the turbine blade 22. FIG. 3 shows a schematic view of a portion of the shank 40.

The shank 40 includes spaced-apart left and right side faces 58 which are contoured in a specific manner, and may be described as having several distinct "portions". At the radially inner end (or inboard end), The side faces 58 define the dovetail 36 that includes a pair of spaced-apart, divergent pressure faces 60.

Just outboard of the dovetail 36, there is a first neck portion 62. In the first neck portion 62, each side face 58 defines a concave curve. At the radially outer end of the first neck portion 62, it defines a first (or primary) minimum neck 64, where the thickness of the shank 40 in the tangential direction T is at a local minimum relative to the immediately surrounding structure. As used herein the term "minimum neck" does not necessarily imply any specific dimensions. The portions of the side faces 58 defining the first or primary minimum neck 64 have a first radius "R1".

Just outboard (or radially outward) of the primary minimum neck 64, there is a first transition portion 66. In the first transition portion 66, each side face 58 defines a smooth convex curve. Other configurations of the side faces 58 which could produce similar results include straight lines or spline shapes.

Outboard of first transition portion 66, there is a second or secondary neck portion 68. In the secondary neck portion 68, each side face 58 defines a smooth concave curve having a second radius "R2". The radius R2 is larger than the radius R1. The secondary neck portion 68 defines a second (or secondary) minimum neck 70, where the thickness of the shank 40 in the tangential direction T is at a local minimum relative to the immediately surrounding structure.

A second transition portion 72 is disposed outboard of the secondary neck portion 68. In the second transition portion 72, each side face 58 defines a smooth convex curve. Other configurations of the side faces 58 which could produce similar results include straight lines or spline shapes.

An outboard portion 74 is disposed outboard of the second transition portion. In the outboard portion 74, the side faces 58 are generally parallel to each other as they transition to the airfoil geometry.

The profile of the side faces 58 is shaped so as to be compatible with composite materials. The reinforcing fibers generally follow the contours of (i.e. are parallel to) the side faces 58. The side faces 58 are contoured such that the fibers will not buckle or wrinkle where outward cusps are located. While the profile of the side faces 58 has been illustrated as exemplary two-dimensional sectional views, it is noted that the actual shape may be different at each axial section. In other words, applicability to actual 3D blade shanks will follow this configuration described above, but adds another dimension to tailor the geometry.

In the illustrated example, the thickness of the shank 40 in the tangential direction "T" is significantly less (from a functional standpoint) at the location of the secondary minimum neck 70 than at the primary minimum neck 64. The exact shapes and dimensions of the side faces 58 may be altered to suit a particular application and the specific composite material used.

Generally, PMC materials are highly orthotropic. One example of a known PMC is a carbon fiber reinforced epoxy, which would typically be used in a fan blade. Other fiber materials such as boron or silicon carbide are also known. Other matrix materials such as phenolic, polyester, and polyurethane for example, are known as well.

Generally, CMC materials are less orthotropic than PMC materials, and may be have properties which are close to isotropic. Examples of known CMC materials include a ceramic type fiber for example SiC, forms of which are coated with a compliant material such as Boron Nitride (BN). The fibers are carried in a ceramic type matrix, one form of which is Silicon Carbide (SiC). CMC materials would typically be suitable for a turbine blade.

By addition of a secondary minimum neck 70 above the primary minimum neck 64 the shank interlaminar stiffness is softened to allow the resultant interlaminar stress to be distributed over a larger area, thus reducing the peak interlaminar tensile stress value. Analysis has shown that the shank configuration described above can lower the peak interlaminar tensile stress by a significant amount, for example about 20% to 30%, as compared to the prior art configuration. This configuration can be used to add design margin at the minimum neck of the blade in order to enable designs to be able carry more radial loads, via larger engine radius or higher speed applications, or to add interlaminar stress margin to existing blade designs.

This configuration also enables additional high cycle fatigue ("HCF") capability for blades by allowing the vibratory modes of the blade which have inflection at or near the primary minimum neck per the prior art sketch (i.e. 1st flex or 1F), to then inflect about the thinner net section of the secondary minimum neck, which has a lower radial static stress due to the larger radius and associated lower stress concentration factor, to enable a larger allowance for HCF stress.

The foregoing has described an interlaminar stress reducing configuration for composite turbine components. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A turbomachinery blade, comprising:

an airfoil; and a shank extending from a root of the airfoil, the shank being constructed from a composite material including reinforcing fibers embedded in a matrix, wherein the shank includes a pair of spaced-apart side faces, the side faces cooperatively defining:

a dovetail disposed at a radially inboard end of the shank, comprising spaced-apart, diverging faces;

a first neck portion having a concave curvature disposed radially outboard of the dovetail, and defining a primary minimum neck at which a thickness of the shank is at a local minimum; and a second neck portion disposed radially outboard of the first minimum neck, the second neck portion having a concave curvature and defining a secondary minimum neck at which the thickness of the shank is at a local minimum;

wherein a first transition portion is disposed between the first neck portion and the second neck portion, and wherein the side faces are convex-curved within the first transition portion.

2. The turbomachinery blade of claim 1 wherein:

the first neck portion has a first radius; and the second neck portion has a second radius substantially greater than the first radius.

3. The turbomachinery blade of claim 1 wherein the thickness of the shank at the second neck portion is significantly less than the thickness at the first neck portion.

4. The turbomachinery blade of claim 1 wherein the airfoil includes: leading and trailing edges extending between a root and a tip, and opposed pressure and suction sides joined together at the leading and trailing edges.

5. The turbomachinery blade of claim 1 wherein a second transition portion is disposed outboard of the second neck portion, and wherein the side faces are convex-curved within the first transition portion.

6. The turbomachinery blade of claim 5 wherein an outboard portion is disposed outboard of the second transition portion, and wherein the side faces are generally parallel to each other within the outboard portion.

7. The turbomachinery blade of claim 1 wherein the composite material has a strength ratio of fiber direction to matrix direction of at least about 10 to 1.

8. The turbomachinery blade of claim 1 wherein the composite material is a polymer matrix composite.

9. The turbomachinery blade of claim 1 wherein the composite material is a ceramic matrix composite.

* * * * *